US006138702A

United States Patent [19]

Carter

[11] Patent Number: 6,138,702

[45] Date of Patent: Oct. 31, 2000

[54] RESILIENT SUPPORT FOR ERECTABLE SHELTER ROOF

[76] Inventor: Mark C. Carter, 1601 Iowa Ave., Riverside, Calif. 92507

[21] Appl. No.: 09/156,313

[22] Filed: Sep. 17, 1998

[51] Int. Cl.[7] ..... E04H 15/50

[52] U.S. Cl. ..... 135/145; 135/151; 135/159; 403/172; 403/175

[58] Field of Search ..... 135/128, 130, 135/131, 143, 145, 151, 152, 158, 114, 159, 103; 52/103; 403/175, 172, 176, 178, 218

[56] References Cited

U.S. PATENT DOCUMENTS

| | | | |
|---|---|---|---|
| 402,755 | 5/1889 | Lyon . | |
| 1,712,836 | 5/1929 | Mills . | |
| 1,853,367 | 4/1932 | Mace . | |
| 2,723,673 | 11/1955 | Call . | |
| 3,810,482 | 5/1974 | Beavers . | |
| 4,601,301 | 7/1986 | Hermanson . | |
| 4,607,656 | 8/1986 | Carter . | |
| 4,641,676 | 2/1987 | Lynch . | |
| 4,779,635 | 10/1988 | Lynch | 135/103 |
| 4,827,958 | 5/1989 | Cantwell et al. . | |
| 4,877,044 | 10/1989 | Cantwell et al. . | |
| 4,945,584 | 8/1990 | LaMantia . | |
| 4,947,884 | 8/1990 | Lynch . | |
| 5,035,253 | 7/1991 | Bortles . | |
| 5,069,572 | 12/1991 | Niksic . | |
| 5,244,001 | 9/1993 | Lynch . | |
| 5,275,188 | 1/1994 | Tsai . | |
| 5,490,532 | 2/1996 | Mallookis et al. . | |
| 5,590,674 | 1/1997 | Eppenbach . | |
| 5,632,292 | 5/1997 | Carter | 135/145 |
| 5,634,483 | 6/1997 | Gwin | 135/131 |
| 5,794,640 | 8/1998 | Jang | 135/131 |

FOREIGN PATENT DOCUMENTS

| | | |
|---|---|---|
| 2 258 475 | 2/1993 | United Kingdom . |
| WO 94/23162 | 10/1994 | WIPO . |

OTHER PUBLICATIONS

International Search Report dated Dec. 1, 1999.

*Primary Examiner*—Carl D. Friedman
*Assistant Examiner*—Yvonne M. Horton
*Attorney, Agent, or Firm*—Fulwider Patton Lee & Utecht, LLP

[57] ABSTRACT

The erectable shelter includes a truss framework that provides an elevated, raised canopy that can have a high peak in a raised, extended configuration. The shelter includes a canopy, a leg assembly, and a perimeter truss linkage assembly having a plurality of perimeter truss pairs of link members connected to the leg assembly. The legs preferably have telescoping upper and lower sections with lower section for engagement with ground, and a slider member slidably mounted to the upper section of each of the legs. A canopy peak support assembly is provided that is movable between a raised position and a lowered position, with the canopy peak support assembly supporting the canopy above the top of the leg assembly in the raised position. The canopy peak support assembly includes a flexible center support member such as a rubber tube or spring coil that can bend in response to the force of strong winds.

12 Claims, 6 Drawing Sheets

RESILIENT SUPPORT FOR ERECTABLE SHELTER ROOF

BACKGROUND OF THE INVENTION

1. Field of the Invention

This invention relates generally to folding, collapsible structures, and more particularly relates to a collapsible, field shelter structure having an elevated canopy that flexes and provides a reduced profile in response to wind.

2. Description of Related Art

Temporary shelters that can be easily transported and rapidly set up at emergency sites can be particularly useful in providing temporary care and housing. Such shelters can also be useful for non-emergency outdoor gatherings, such as for temporary military posts, field trips, and the like. One such quickly erectable, collapsible shelter having a framework of X-shaped linkages, telescoping legs, and a canopy covering the framework is described in my U.S. Pat. No. 4,607,656. The legs of that shelter are capable of telescoping to about twice their stowed length, and the framework of X-shaped truss pairs is capable of horizontal extension between the legs to support a canopy. The framework can be constructed of lightweight material, and the telescoping legs can be extended to raise the framework of the shelter. However, the height of the canopy is limited to the extended length of the legs, and the canopy is essentially flat, allowing for collection of precipitation and debris on top of the canopy, which can promote leaks and tears in the canopy. In addition, the size and stability of the shelter is generally limited by the strength of the framework.

It would be desirable to provide an improved collapsible shelter with a support framework for the canopy that rises above the supporting legs, to provide for more headroom within the structure, and to allow for a reduction in the size and weight of the legs and framework required to achieve an adequate height of the canopy. It would be further desirable to provide collapsible shelter with a support framework shedding precipitation and debris from the top of the shelter, with a canopy that bends and collapses in strong winds, to reduce exposure of the shelter to the force of winds that can lift and topple the shelter, for improved stability in winds. The present invention fulfills these needs.

SUMMARY OF THE INVENTION

Briefly, and in general terms, the present invention provides for a low cost, light weight erectable shelter with a canopy with a central support member that bends to allow the canopy to collapse in strong winds, to reduce exposure of the shelter to the force of winds that can lift and topple the shelter, for improved stability in winds.

The invention accordingly provides for an erectable, collapsible shelter having a collapsed configuration and an extended configuration. The shelter comprises a canopy having at least three sides and three corners, a leg assembly having at least three legs supporting the canopy, the legs having an upper end and a lower end, and a perimeter truss linkage assembly having a plurality of perimeter truss pairs of link members connected to the leg assembly. The legs preferably have telescoping upper and lower sections with lower section for engagement with ground, and a slider member slidably mounted to the upper section of each of the legs.

Each of the perimeter truss pairs preferably includes first and second link members pivotally connected together in a scissors configuration, the first and second link members having inner and outer ends, the outer end of each the first link member connected to the upper end of one of the legs, and the outer end of each second link slidably connected to the leg. A canopy peak support assembly is provided that is movable between a raised position and a lowered position, with the canopy peak support assembly supporting the canopy above the top of the leg assembly in the raised position. In a presently preferred embodiment, the canopy peak support assembly comprises a flexible center support member that can bend in response to the force of strong winds, and the flexible center support member currently preferably can be formed of an elastomer, such as a rubber cylinder or tube, or spring coil, or the like. Alternatively, the central support can be a tubular member which contains a middle spaced apart section containing a spring or resilient member to provide the desired flexibility.

These and other aspects and advantages of the invention will become apparent from the following detailed description, and the accompanying drawing, which illustrates by way of example the features of the invention.

DETAILED DESCRIPTION OF THE PREFERRED EMBODIMENTS

The size and available headroom of previous collapsible shelters have been generally limited by the extended length of the legs of the structure, and provided essentially flat roof structures, allowing for collection of precipitation in pockets or puddles on top of the shelter. The collapsible shelter of the invention provides for a low cost, light weight erectable shelter with a canopy with a central support member that bends to allow the canopy to collapse in strong winds, to reduce exposure of the shelter to the force of winds that can lift and topple the shelter, for improved stability in winds.

Figure 1:
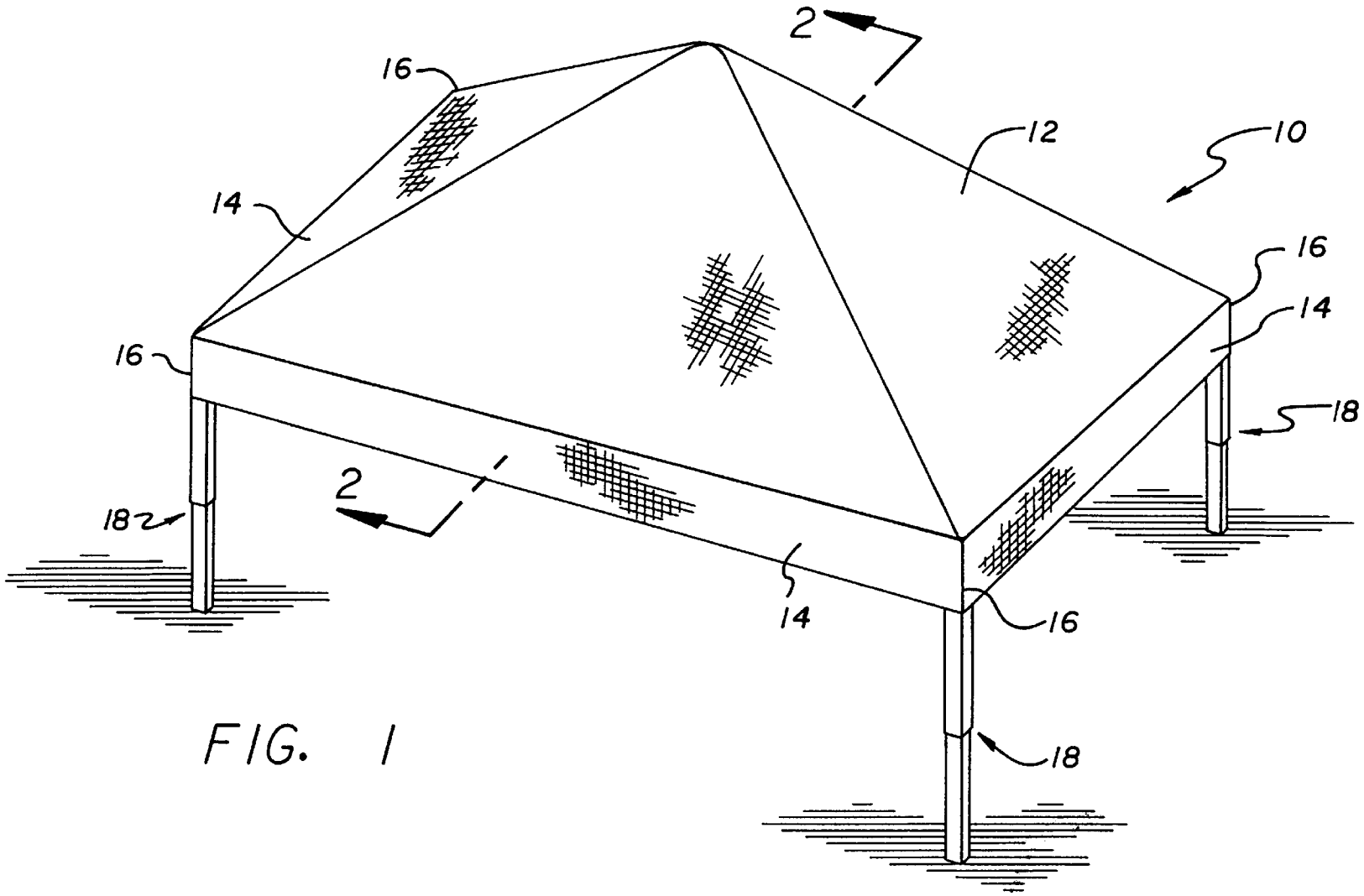
FIG. 1 is a perspective view of a presently preferred high peaked embodiment of the erectable shelter of the invention, showing the roof structure.

As is illustrated in the drawings, and particularly referring to a first preferred four-sided embodiment shown in FIG. 1, the invention is embodied in an erectable shelter 10, having a canopy 12 with at least three sides 14, and preferably four sides, at least three corners 16, and preferably four corners. The canopy is preferably formed of nylon fabric, so as to be light and easily transportable, although the canopy could also be made of other suitable sheet materials, such as canvass, or other types of cloth fabric, or plastic. At least three, and preferably four, legs 18 support the canopy, with a leg disposed under each corner of the canopy. Particularly referring to FIG. 2, each of the legs has an upper end 20 and a lower end 22, and preferably each leg includes telescoping upper and lower sections 24 and 26, respectively, with the telescoping lower section including a spring loaded detent pin 27 for indexing in apertures 28 provided in the upper section for adjusting the leg height as desired. The extendable lower section also preferably includes a foot portion 29 for engagement with the ground or other floor surface.

Figure 2:
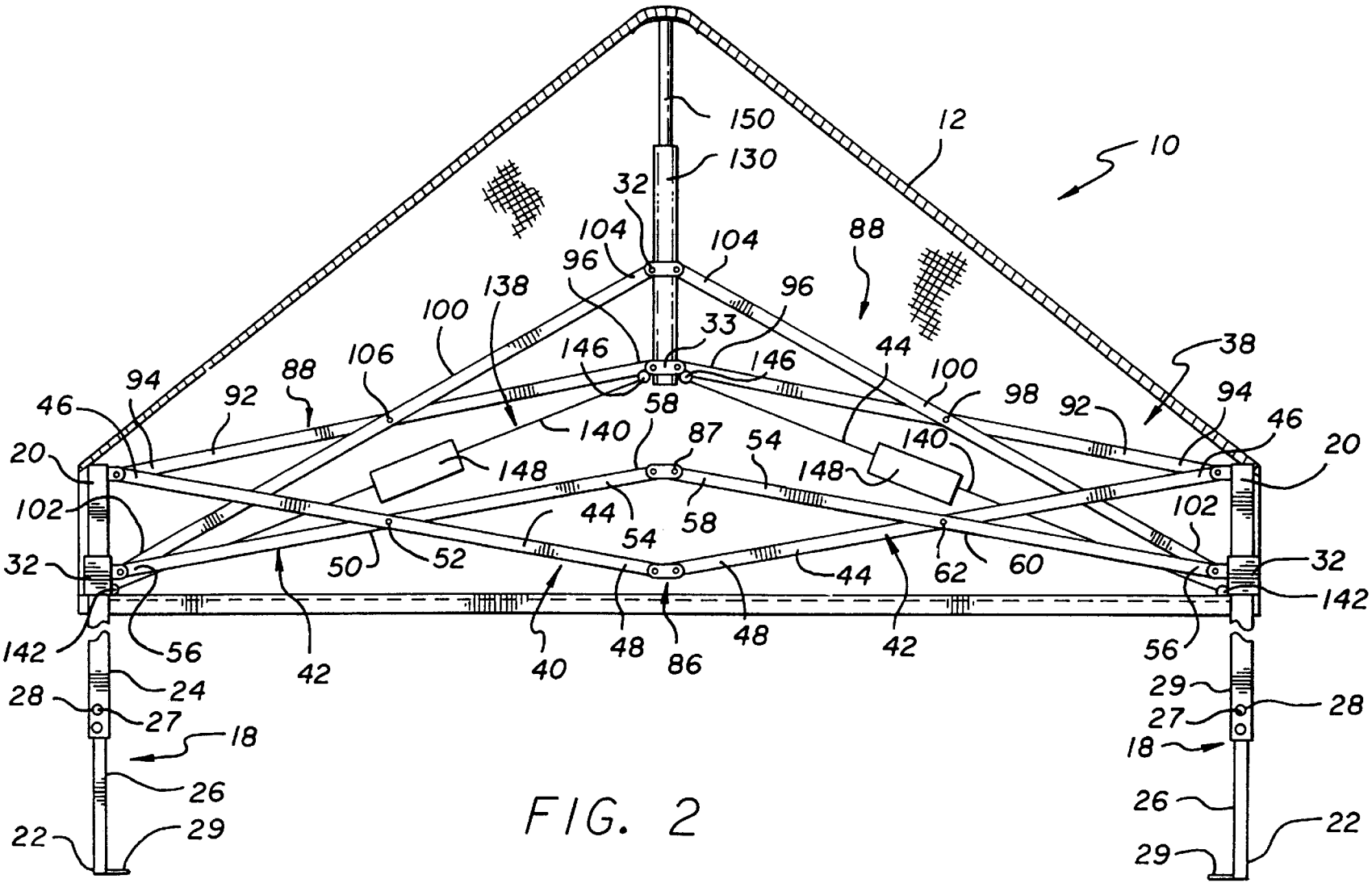
FIG. 2 is a cross-sectional elevational view taken along line 2—2 of FIG. 1, showing the perimeter and central truss pairs of the shelter in an extended, raised configuration.

With reference to FIG. 2, a leg slider member 32 is also slidably mounted on the upper section of each of the legs. Similarly, an additional leg slider member 33 is slidably mounted on the lower section of the legs. In combination, members 32 and 33 comprise a mounting means connected to a vertically oriented central support member 130. A spring loaded detent pin is also provided in the upper leg section for indexing with an aperture in the leg slider member.

Figure 5:
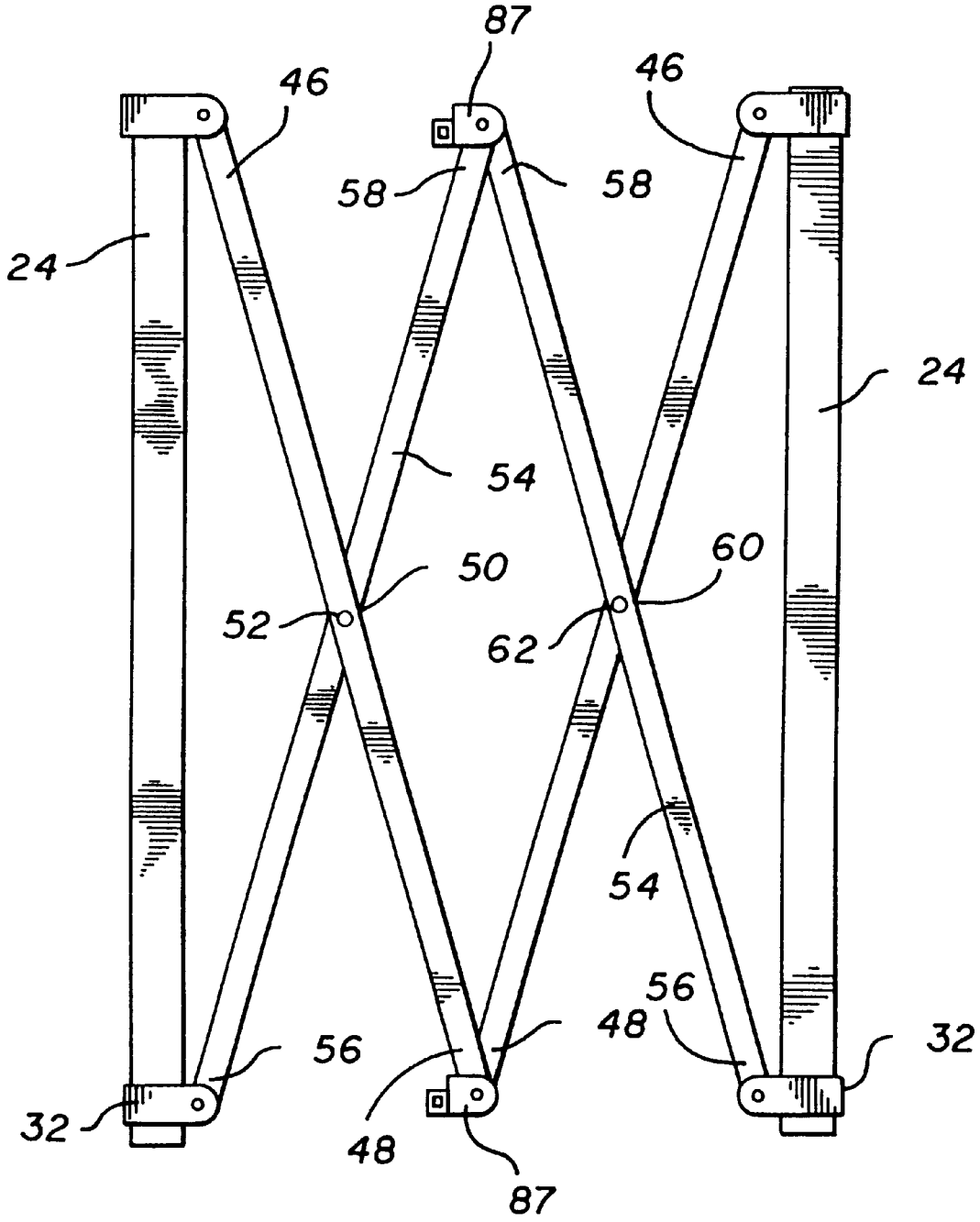
FIG. 5 is a side elevational view of the framework of the collapsible shelter of FIG. 1, showing the perimeter truss pairs in a substantially collapsed configuration.

Referring to FIGS. 2 and 5, in the third alternate embodiment, the perimeter framework 38 includes perimeter truss means 40 including two perimeter truss pairs 42 of link members connected to each of the legs at right angles, with each of the perimeter truss pairs including a first link member 44 having an outer end 46 connected to the upper end of a leg, an inner end 48, a longitudinal center 50, and a centrally located pivot point 52 pivotally connected to a second link 54 having an outer end 56 pivotally connected to the leg slider member, thus slidably connecting the second link to the upper section of the leg. The second link of the perimeter truss pairs includes an inner end 58, a longitudinal center 60, and a centrally located pivot point 62. The first and second links in each of the perimeter truss pairs are pivotally connected at their pivot points in a standard scissors configuration.

The inner ends 48, 58 of each perimeter truss pair are further preferably pivotally connected to the inner ends 48, 58 of another perimeter truss pair at a junction 86 centered between two legs of one side of the shelter framework.

Figure 3:
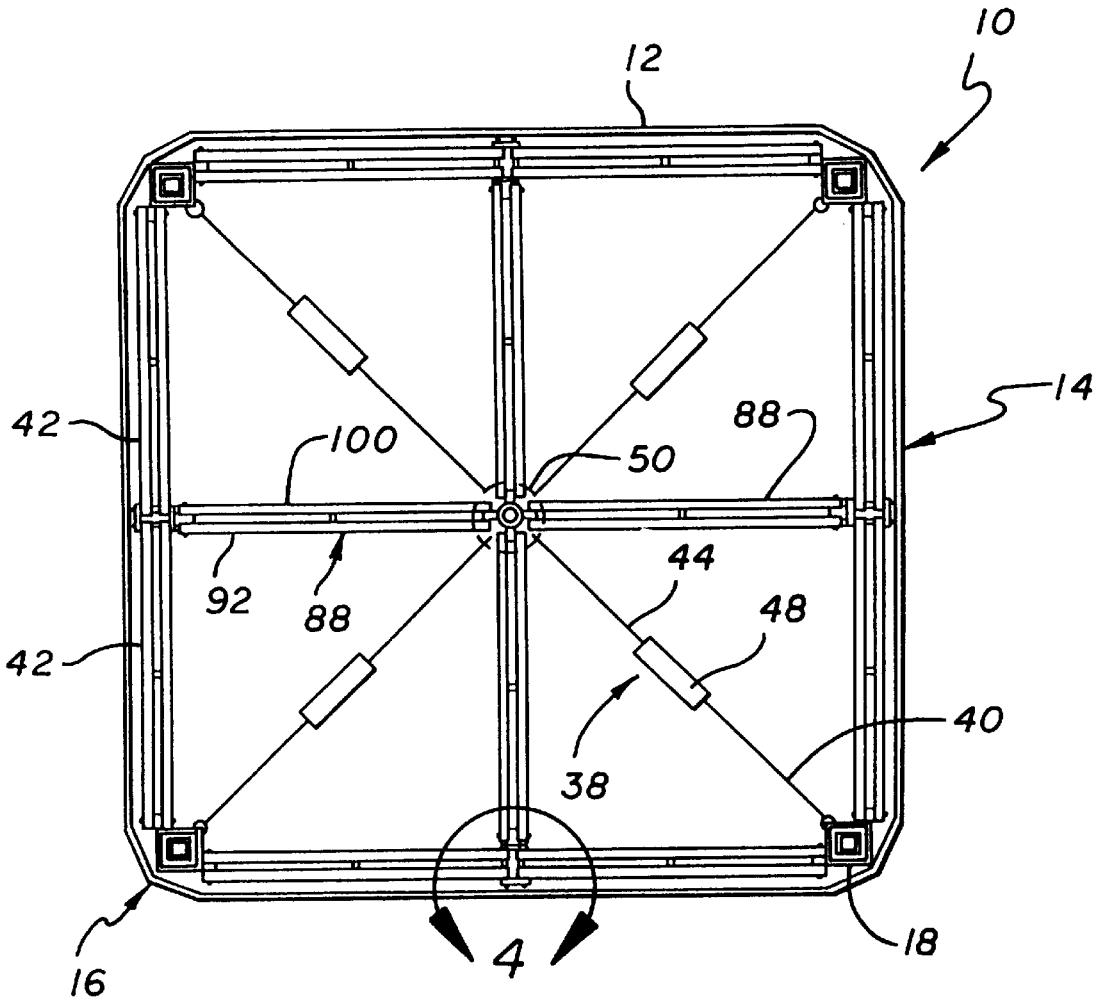
FIG. 3 is a top sectional view of the collapsible shelter of FIG. 1.
Figure 4:
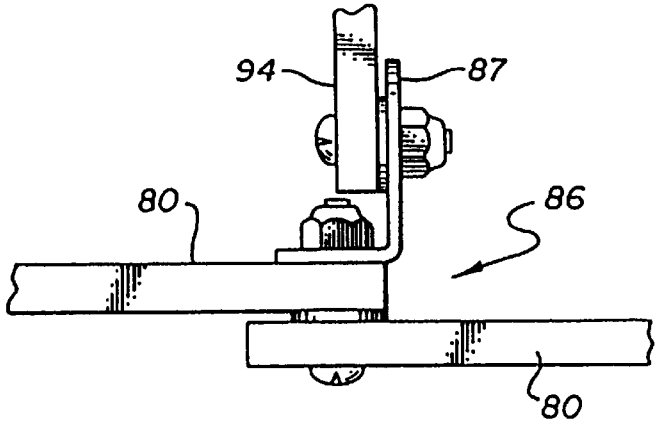
FIG. 4 is an enlarged view of a portion of the linkage between the perimeter truss pairs and the central truss pairs.

As is best seen in FIGS. 2 to 4, a plurality of central truss pairs 88 of link members are also provided, with each of the central truss pairs being pivotally connected to the inner ends of the perimeter truss pairs at the junction 86, such as by right angle bracket members 87, to which the inner ends of the perimeter truss pairs and the central truss pairs are pivotally connected. In this third embodiment, the framework of the shelter has a square configuration, and four central truss pairs are provided, connected to the four side junctions of the shelter framework. Where the shelter framework has three sides, three central truss pairs may be provided, as will be further explained below. Each of the central truss pairs preferably includes a first link 92 having an outer end 94 connected to an inner end of at least one of the first links of a perimeter truss pair on a side, an inner end 96, and a pivot point 98 located at the longitudinal center point of the central truss pair first link. Each of the central truss pairs also preferably includes a second link 100 having an outer end 102 connected to an inner end of at least one of the second links of the perimeter truss pairs on a side, an inner end 104, and a pivot point 106 located at the longitudinal center point of the central truss pair second link. The second links of the central truss pairs are preferably longer than the first links of the central truss pairs, so that in an expanded configuration of the shelter, the second link extends well above the top of the legs, to give the shelter a high peaked canopy. For example, for a first link of approximately 10 feet six inches in length, the second link can be approximately 12 feet long, with the top, inner end of the second link reaching approximately 4 feet above the top of the legs and the junction of the perimeter truss pairs.

The inner ends of the first or second links of the central truss pairs are further preferably connected to at least one vertically oriented central support member 130, provided to support the canopy and give the canopy a high pitch, high peaked shape when the shelter framework is in an extended configuration. In a preferred embodiment, the central truss pairs are pivotally connected to the central support member by a bracket 132. A central slider member 133 is pivotally connected to the inner ends of the other of the first or second links of the central truss pair, and is disposed to slidably engage and stabilize the central support member when the shelter framework is in an extended configuration.

Figure 6:
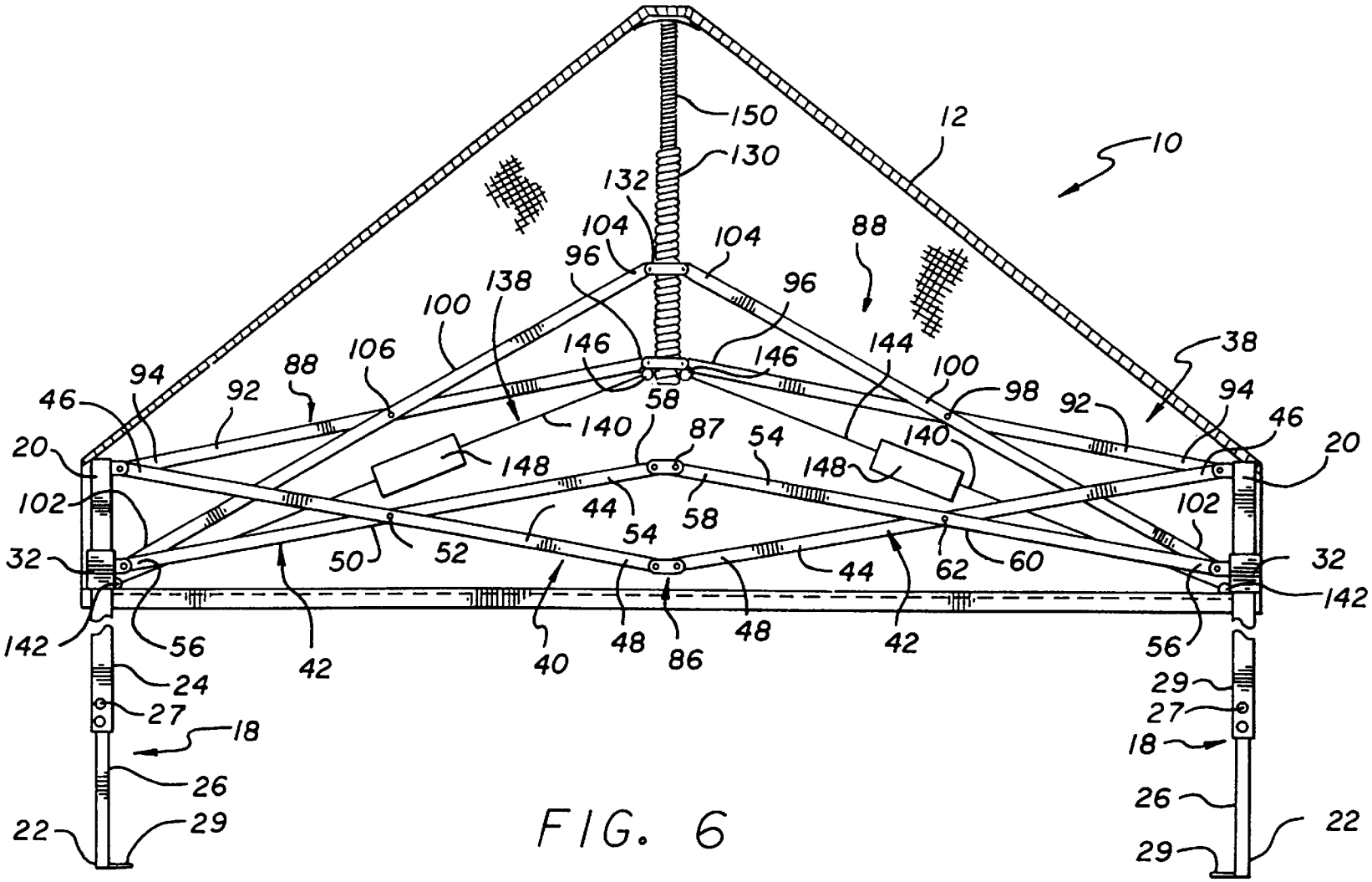
FIG. 6 is a sectional view similar to that of FIG. 2, showing a second preferred embodiment utilizing a flexible central support member formed of a coil spring.
Figure 7:
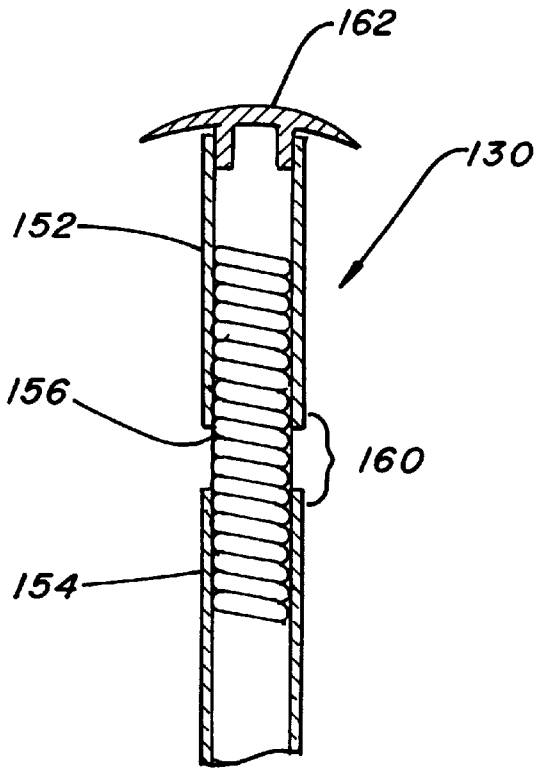
FIG. 7 is a cross section of a third preferred embodiment utilizing a flexible coil with a pair of tubular members to provide the flexible support.
Figure 8:
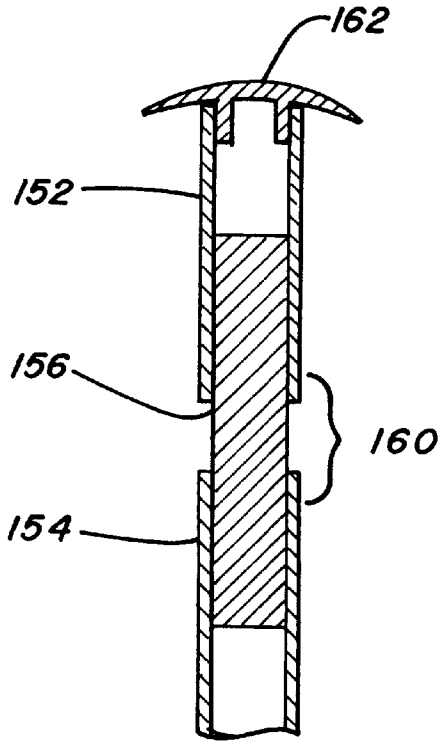
FIG. 8 is a cross section of a fourth preferred embodiment utilizing a resilient member within the central support.

A tensioning means 138 is preferably connected between the leg slider member and the central support slider member for adding strength and stability to the extended configuration of the shelter framework. The tensioning means preferably includes a first cable 140 secured to each leg by a bracket 142 on the leg slider, a second cable 144 secured to a bracket 146 on the center slider, and a cable lock 148, such as an over center type of cable lock, for example, securing the first and second cables together. In a presently preferred embodiment, the central support member includes a peak pole member 150, for further extending the top center of the canopy above the shelter framework, to draw the canopy tight. According to a presently preferred embodiment of the invention, the central support member 130 and/or the peak pole member 150 can be constructed so as to be sturdy but flexible, so as to be biased to have a normally longitudinal configuration to strongly support the peak of the canopy, but to bend under the force of strong winds on the canopy of the shelter, allowing the otherwise high profile of the canopy to collapse under the force of strong winds, to reduce exposure of the shelter to the force of winds that can lift and topple the shelter, for improved stability in winds. The central support member 130 and/or the peak pole member 150 can be a cylinder or tube constructed of a flexible elastomer, such as rubber, or polyurethane, with the appearance as shown in FIG. 2, for example. Alternatively, in another preferred embodiment illustrated in FIG. 6, the central support member 130 and/or the peak pole member 150 can be constructed of heavy duty coil springs that are biased in a longitudinal configuration as shown in FIG. 6, but that can collapse under the force of strong winds, to reduce exposure of the shelter to the force of winds. In a third currently preferred embodiment illustrated in FIG. 7, the central support 130 can be made of tubular members 152 and 154 which are spaced apart and within which is inserted spring 156 to provide the desired flexibility, such flexibility being controlled by the stiffness of the spring and the exposed length 160 between sections 152 and 154, which are capped by the canopy support 162. Similarly, as illustrated in FIG. 8, the spring member may be replaced by a central support 130, the stiffness of which may be varied on the basis of size and material to provide the desired flexibility. The resilient material can be either rubber, plastic, or any other suitable material that is more bearable and spring-like than the vertical members 152 and 154.

In light of the above description, it will be apparent that the invention provides for a quickly erectable shelter having an elevated roof, that is raised to provide more headroom, a high, sloped peaked roof to shed precipitation and debris, and a canopy with a central support member that bends to allow the canopy to collapse in strong winds, to reduce exposure of the shelter to the force of winds that can lift and topple the shelter, for improved stability in winds.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. An erectable, collapsible shelter having a collapsed configuration and an extended configuration, comprising:

a canopy having at least three sides and three corners;

a leg assembly having at least three legs supporting said canopy, said legs having an upper end and a lower end;

a perimeter truss linkage assembly having a plurality of perimeter truss pairs of link members connected to said leg assembly; and a canopy peak support assembly connected to said leg assembly and movable between a raised position and a lowered position, said canopy peak support assembly supporting said canopy above the top of the leg assembly in said raised position, and said canopy peak support assembly including a mounting means connected to said leg assembly and a flexible, resilient center support member connected to the mounting means, said flexible, resilient center support member comprising a lower non-bending portion restrained from bending by the mounting means, and an upper flexible, resilient portion that is unrestrained by the mounting means from bending in response to the force of strong winds.

2. The erectable, collapsible shelter of claim 1, wherein each of said legs comprise telescoping upper and lower sections, with said lower section being adapted for engagement with the ground.

3. The erectable, collapsible shelter of claim 1, wherein said leg assembly comprises a slider member slidably mounted to each of said legs.

4. The erectable, collapsible shelter of claim 1, wherein each of said perimeter truss pairs includes first and second link members pivotally connected together in a scissors configuration, said first and second link members having inner and outer ends, said outer end of each said first link member connected to the upper end of one said leg, and said outer end of each second link slidably connected to said leg.

5. The erectable, collapsible shelter of claim 1, wherein said flexible, resilient center support member comprises an elastomeric cylinder.

6. The erectable, collapsible shelter of claim 1, wherein said flexible, resilient center support member comprises an elastomeric tube.

7. The erectable, collapsible shelter of claim 1, wherein said flexible, resilient center support member comprises a spring coil.

8. The erectable, collapsible shelter of claim 1, wherein said flexible, resilient center support comprises two rigid vertical members joined by a flexible, resilient member.

9. The apparatus of claim 8, wherein said flexible, resilient member is a spring.

10. The apparatus of claim 8, wherein said flexible, resilient member is a column made of a resilient material.

11. The apparatus of claim 10, wherein said resilient material is rubber.

12. The apparatus of claim 10, wherein said resilient material is plastic.

* * * * *